United States Patent [19]

Sawai et al.

[11] Patent Number: 5,057,873

[45] Date of Patent: Oct. 15, 1991

[54] METHOD OF CLEANING A TRANSFER DRUM OF AN ELECTROPHOTOGRAPHIC APPARATUS

[75] Inventors: Yuji Sawai; Toshio Nakahara, both of Yokohama, Japan

[73] Assignee: Ricoh Company, Ltd., Tokyo, Japan

[21] Appl. No.: 460,627

[22] Filed: Jan. 3, 1990

[30] Foreign Application Priority Data

| | | | |
|---|---|---|---|
| Jan. 9, 1989 | [JP] | Japan | 1-3341 |
| Jan. 9, 1989 | [JP] | Japan | 1-3342 |
| Jan. 9, 1989 | [JP] | Japan | 1-3343 |
| Jan. 9, 1989 | [JP] | Japan | 1-3344 |
| Dec. 15, 1989 | [JP] | Japan | 1-325633 |

[51] Int. Cl.[5] ..... G03G 15/16; G03G 15/01

[52] U.S. Cl. ..... 355/271; 355/326; 355/301

[58] Field of Search ..... 355/271, 272, 274, 301, 355/302, 303, 326, 327, 297, 215; 15/256.52; 430/126

[56] References Cited

U.S. PATENT DOCUMENTS

| | | | |
|---|---|---|---|
| 3,819,263 | 6/1974 | Draugelis et al. | 355/215 |
| 4,483,610 | 11/1984 | Takada | 355/297 |
| 4,786,943 | 11/1988 | Fukae et al. | 355/302 |
| 4,870,466 | 9/1989 | Iida | 355/297 |
| 4,875,069 | 10/1989 | Takada et al. | 355/271 |

*Primary Examiner*—Joan H. Pendegrass

*Attorney, Agent, or Firm*—Oblon, Spivak, McClelland, Maier & Neustadt

[57] ABSTRACT

A method of cleaning a transfer drum, which is located to face a photoconductive drum, to remove a toner left untransferred on a transfer film which is wound around the transfer drum. A fur brush rotatable in contact with the transfer drum for removing the toner from the drum and a toner collecting roller rotatable in contact with the fur brush for removing the toner from the brush are prepared. Before the fur brush begins cleaning the transfer film, the toner collecting roller collects the toner deposited on the fur brush. The fur brush is prevented from rubbing itself against a clamping section which is provided on the transfer drum for retaining a paper sheet. The transfer film is discharged while being cleaned. Before the transfer drum is cleaned, the photoconductive drum is cleaned twice or more.

10 Claims, 8 Drawing Sheets

METHOD OF CLEANING A TRANSFER DRUM OF AN ELECTROPHOTOGRAPHIC APPARATUS

BACKGROUND OF THE INVENTION

The present invention relates to a method of cleaning a transfer drum accommodated in an image transferring device of an electrophotographic apparatus and located to face a photoconductive element, or image carrier.

An electrophotographic apparatus of the kind electrostatically forming a latent image on an image carrier which is implemented as a photoconductive element, developing the latent image to produce a toner image, transferring the toner image to a paper sheet, and fixing it has been proposed in various forms. An image transferring device installed in such an apparatus has a transfer drum which is located to face the photoconductive element for retaining a paper sheet thereon. The transfer drum is provided with a clamper section for clamping one end of a paper sheet, and a transfer film. The transfer drum, i.e., the transfer film provided thereon is cleaned by a transfer drum cleaning device. The cleaning device is made up of a fur brush for cleaning the transfer drum, a toner collecting roller rotatable in contact with the fur brush, and a blade for scraping a toner off the toner collecting roller. In such an electrophotographic apparatus, e.g., a color electronic copier, a paper sheet is clamped by the clamper section of the transfer drum and wound around the drum, i.e. transfer film. Then, the photoconductive drum and transfer drum are driven in a rotary motion at the same time. A cyan toner image, magenta toner image and yellow toner image are sequentially formed on the photoconductive drum and sequentially transferred, by a transfer charger, one upon another to the same position on the paper sheet. On completion of such image transfer, a separator in the form of a pawl separates the paper sheet from the transfer drum. Subsequently, a fixing device fixes the toner image on the paper sheet while driving the paper sheet out of the copier to a copy tray. A problem with this type of copier is that after the image transfer the toner on the photoconductive drum is apt to deposit on the areas of the transfer film of the transfer drum other than the area where the paper sheet is wound, resulting in the surface of the transfer film being smeared. The transfer drum, therefore, has to be sufficiently cleaned, especially when the paper size is changed from small one to large one. This need is satisfied by the transfer drum cleaning device.

Specifically, the fur brush of the cleaning device is held in contact with the transfer film on the transfer drum so as to cause the toner on the film to deposit on the brush. The toner collecting roller rotating in contact with the fur brush is applied with a bias voltage so that the toner is handed over to the roller, while the blade scrapes that toner off the roller. However, the prior art transfer drum cleaning device constructed and operated as described above has some problems left unsolved, as enumerated below.

(1) The fur brush having cleaned the transfer drum, or transfer film, has some toner remaining thereon despite the operation of the toner collecting roller.

(2) Since the fur brush contacts the entire surface of the transfer drum or transfer film while in operation, the toner deposited on the fur brush is apt to accumulate in recesses which are formed in the clamper section. This part of toner accumulated in the recesses would smear one or both sides of a leading edge portion of a paper sheet to be clamped next.

(3) When a paper jam occurs in the electrophotographic apparatus, the toner is left untransferred on the photoconductive drum. Then, after the paper jam has been reset, the photoconductive drum is cleaned by an exclusive cleaning device independent of the transfer drum cleaning device. At the same time, the transfer drum or transfer film is cleaned by the transfer drum cleaning device. While the transfer film is cleaned, the transfer charger continuously charges the transfer film. As a result, during the cleaning operation, a substantial amount of untransferred toner is handed over from the photoconductive drum to the transfer film. In the transfer drum cleaning device, the untransferred toner so deposited on the transfer film is difficult to remove and, therefore, often constitutes a cause of smear.

(4) While the fur brush adapted to clean the transfer drum or transfer film is made of an insulative material, it is rotated at a speed thirty times higher than the linear velocity of the transfer drum. A motor for driving such a fur brush, therefore, generates offensive noise, and the fur brush is not durable.

(5) A method of cleaning the photoconductive drum by using a conductive fur brush is known in the art. This kind of method is implemented by a precleaning charger which uniformly charges the photoconductive drum by a DC-biased DC or AC voltage, so that the remaining toner is removed by electrostatic induction. On the other hand, the surface portion of the transfer drum or transfer film that faces the photoconductive drum is charged by the transfer charger at the time of image transfer. A problem given rise to at this instant is that the transfer film has to be discharged before the image transfer, i.e., the potential of the transfer film has to be brought to substantially zero volt before image transfer begins. Should the transfer film be not discharged sufficiently, there would occur incomplete image transfer. Hence, every time a copying cycle is completed, the transfer drum or transfer film has to be cleaned and then discharged to substantially zero volt. Further, during image transfer the toner on the photoconductive drum deposits on the transfer film other than the area where a paper sheet is wound, as stated earlier. In this condition, when the transfer charger charges the film surface to intense positive polarity, for example, the toner deposited on the transfer film as mentioned above will be also charged to the same polarity as the film. Assuming that the potential of the transfer film is as high as positive 500 volts to several kilovolts, causing a chargeable brush into contact with the film surface will result in a discharge and, therefore, in a smear due to the discharge. The polarity of the toner deposited on the transfer film is apt to reverse, further aggravating the difficulty of cleaning. The DC-biased DC or AC voltage applied to the transfer charger would accelerate such a discharge and thereby make the smear problem more serious.

SUMMARY OF THE INVENTION

It is therefore an object of the present invention to provide a method of cleaning a transfer drum of an electrophotographic apparatus, which method is free from the drawbacks particular to the prior art as discussed above.

It is another object of the present invention to provide a generally improved method of cleaning a transfer drum of an electrophotographic apparatus.

In an electrophotographic apparatus comprising a movable image carrier for forming a toner image thereon, and a transfer drum device located to face the image carrier and having a transfer film wound around the transfer drum device and a clamping section for clamping a paper sheet to which the toner image is to be transferred, a transfer drum cleaning method of the present invention comprises the steps of preparing a fur brush rotatable in contact with the transfer film of the transfer drum device for removing a toner left untransferred on the transfer film, and a toner collecting roller rotatable in contact with the fur brush for collecting the toner from the fur brush, applying a bias voltage to the toner collecting roller to collect the toner from the fur brush, and cleaning the transfer film of the transfer drum device by the fur brush.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
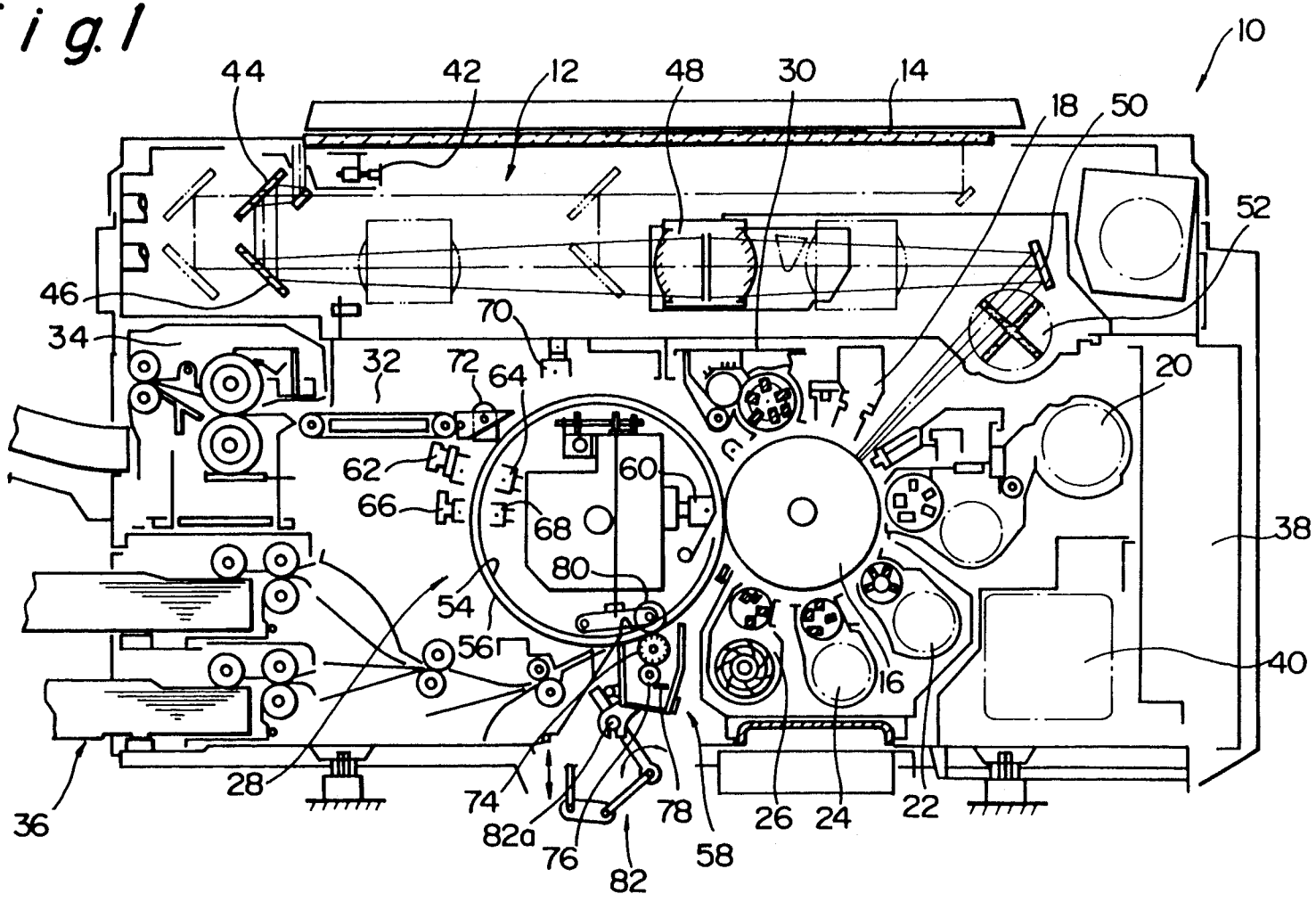
FIG. 1 is a sectional side elevation of a color copier belonging to a family of electrophotographic apparatuses to which the method of the present invention is applicable.

Referring to FIG. 1 of the drawings, a color copier to which the present invention is applied is shown by way of example and generally designated by the reference numeral 10. As shown, the copier 10 has a glass platen 14 to be loaded with a document, optics 12 for scanning the document, and an image carrier in the form of a photoconductive drum 16 on which a latent image is to be electrostatically formed by the optics 12. Arranged around the photoconductive drum 16 are various process implements, i.e., a charging device 18, a black developing unit 20, a yellow developing unit 22, a magenta developing unit 24, a cyan developing unit 26, a transfer and separation device 28, and a photoconductive drum cleaning device 30. The copier 10 further has a paper transporting device 32, a fixing device 34, a paper feeding device 36, a control device 38, and a power source device 40. The optics 12 is made up of a light source 42, mirrors 44 and 46, a lens 48, a mirror 50, and a color separating filter assembly 52. The transfer and separation device 28 has a transfer drum 54, a transfer film 56, a transfer drum cleaning device 58, a transfer charger 60, DC dischargers 62 and 64, AC dischargers 66 and 68, a paper discharger 70, and a separating pawl 72. Further, the transfer drum cleaning device 58 has a conductive fur brush 74, a toner collecting roller 76, a toner collecting blade 78, a back-up roller 80, and a support and drive mechanism 82.

Figure 2:
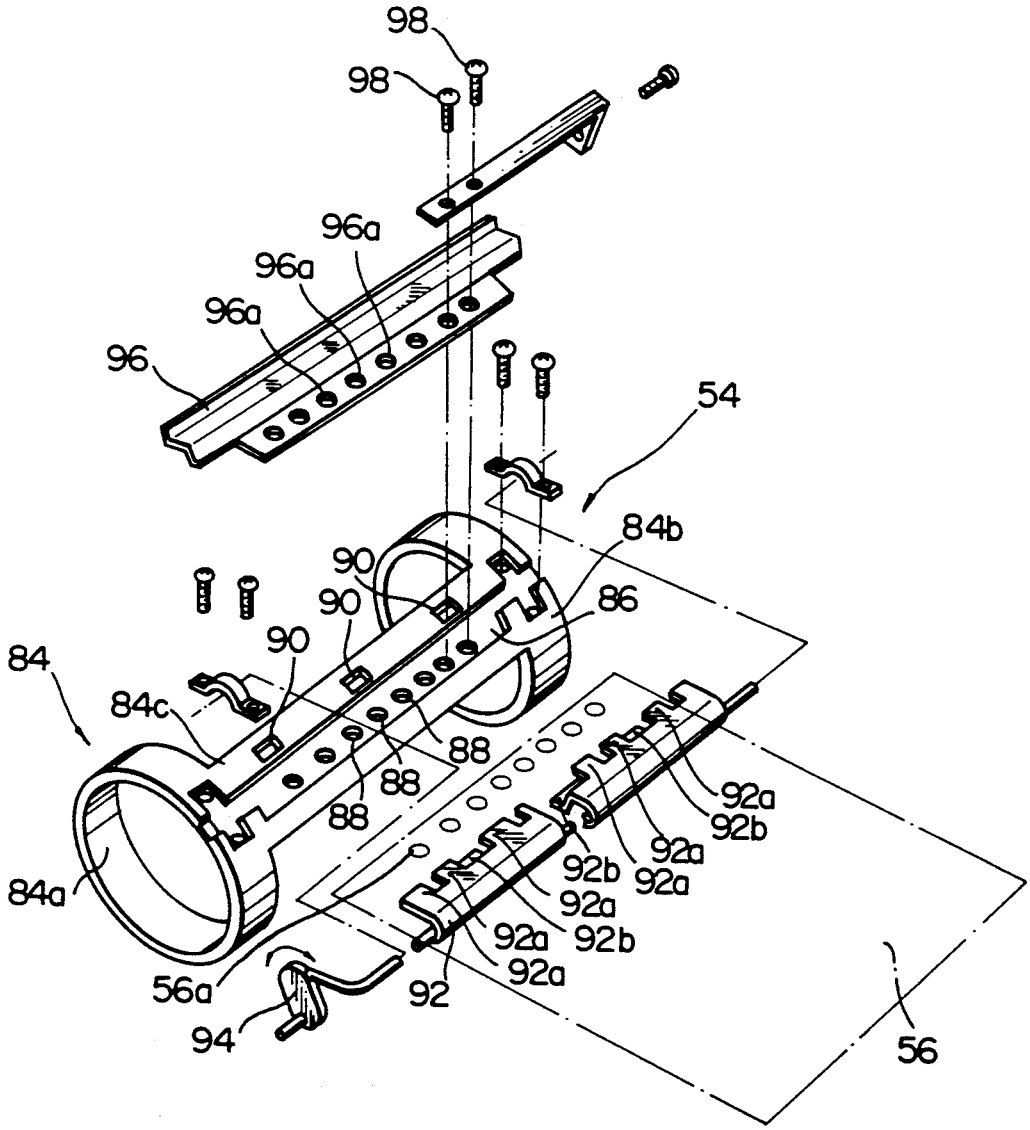
FIG. 2 is an exploded perspective view of a transfer drum included in the copier of FIG. 1.
Figure 3:
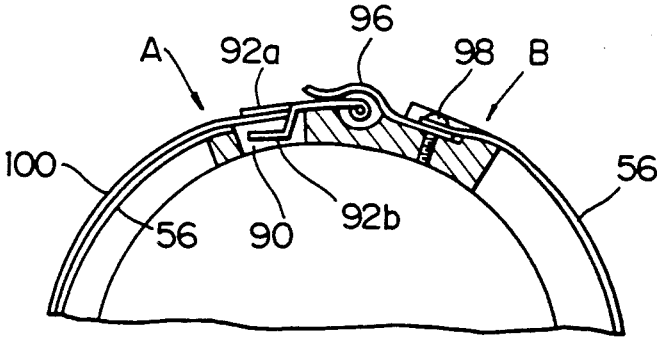
FIG. 3 is a sectional front view of a gripper arrangement provided on the transfer drum.
Figure 4:
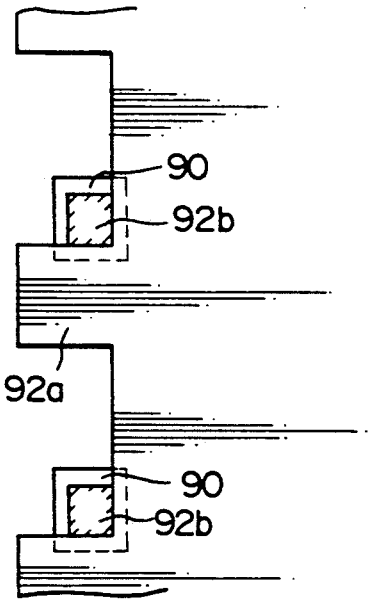
FIG. 4 is a top plan view of clamping pieces shown in FIG. 3.

Referring to FIGS. 2 to 4, the transfer and separation device 28 and transfer drum cleaning device 58 will be described in detail. As shown in FIG. 2, the transfer drum 54 has a frame 84 which is composed of spaced annular portions or rings **84*a* and 84*b* and a connecting portion or tie-bar 84*c* interconnecting the rings 84*a* and 84*b*. The tie-bar 84*c* is formed with an elongate recess 86 extending in the lengthwise direction of the frame 84. A plurality of threaded holes 88 are formed through the bottom of the recess 86. A plurality of, three in the specific construction, rectangular holes 90 are formed through the tie-bar 84*c*. A gripper 92 has clamping pieces 92*a* and flipping pieces 92*b* which are arranged like the teeth of a comb. The clamping pieces 92*a* are individually configured to mate with the rectangular holes 90 of the tie-bar 84*c*. A control cam 94 is mounted on one end of the gripper 92. A pressing plate or presser 96 is made of an elastic material and provided with holes 96*a* which are individually aligned with the holes 88 of the tie-bar 84*c*. Holes 56*a* are formed through one end of the transfer film 56 which has a rectangular configuration. The transfer film 56 is affixed to the frame 84 by positioning the film 56 such that its holes 56*a* each coincides with respective one of the threaded holes 88 of the tie-bar 84*c*, then applying the presser 96 to the film 56 from the above, and then driving screws 98 into the threaded holes 88 of the tie-bar 84*c*. Subsequently, the transfer film 56 is wound around the rings 84*a* and 84*b* of the frame 84. Then, the other end of the transfer film 56 is fixed to the outer surface of the tie-bar 84*c*** by an adhesive tape.

As shown in FIG. 3, a paper sheet 100 is wound around the transfer film 56 which is mounted on the frame by the above-stated procedure. Specifically, after the leading edge of the paper sheet 100 has been received between the clamping pieces **92*a* and the flipping pieces 92*b* of the gripper 92, the control cam 94 is actuated so that the paper sheet 100 is clamped between the clamping pieces 92*a* and the upper surface of the tie-bar 84*c*. To unclamp the paper sheet 100, the control cam 94 opens the gripper 92 so that the flipping pieces 92*b* flips the leading edge of the paper sheet 100 upward away from the periphery of the transfer drum 54**.

A toner is apt to accumulate in the clamper section where the clamping pieces **92*a* and flipping pieces 92*b* of the gripper 92 and the holes 90 of the tie-bar 84*c* are located, as indicated by hatching in FIG. 4. This part of toner would smear one or both sides of the paper sheet 100 in the event of clamping and unclamping of the paper sheet 100. More specifically, since the clamper section has steps as shown and described, the toner beaten out of the fur brush 74 (FIG. 1) which is rotating in contact with the clamper section accumulates. While this occurrence may be eliminated by depressurizing the interior of the transfer drum cleaning device 58** so as to suck the toner, this kind of scheme not only needs a powerful fan but also causes the toner to stop the filter of the fan.

Referring again to FIG. 1, the conductive fur brush 74 is rotatable against the transfer drum 54 with respect to direction. The toner collecting roller 76 is rotatable in contact with the fur brush 74. To apply an electric field to the fur brush 74 and toner collecting roller 76, a bias voltage is applied to the roller 76 while the brush 74 is connected to ground via a low-voltage element. The transfer drum cleaning device 58 is rotatable about a shaft **82*a* which is included in the support and drive mechanism 82. Specifically, while a copying operation is under way, the cleaning device 58 is rotated such that the fur brush 74 is spaced apart from the transfer drum 54, i.e. transfer film 56. While a cleaning operation is under way, the cleaning device 58 is so rotated as to maintain the fur brush 74 in contact with the transfer film 56. The back-up roller 80 prevents the transfer film 56** from slackening.

The transfer and separation device 28 and transfer drum cleaning device 58 will be operated as follows.

In the event of copying, the transfer drum cleaning device 58 is spaced apart from the transfer drum 54, and the gripper 92 provided on the transfer drum 54 is held open by the control cam 94. As the leading edge of the paper sheet 100 advances to between the clamping pieces 92*a* and the flipping pieces 92*b* of the gripper 92, the gripper 92 is closed. In this condition, the clamping pieces 92*a* and the tie-bar 84*c* of the frame 84 clamp the leading edge of the paper sheet 100 therebetween, whereby the paper sheet 100 is wound around the surface of the transfer film 56. Subsequently, the transfer charger 60 is activated to transfer a toner image from the potoconductive drum 16 to the paper sheet 100. On completion of the image transfer, the control cam 94 opens the gripper 92 with the flipping pieces 92*b* flipping the leading edge of the paper sheet 100 upward. AC is applied to the paper discharger 70. Hence, the paper sheet 100 is separated from the transfer film 56 by the separating pawl 72 while being effected by the paper discharger 70. The separated paper sheet 100 is driven to the fixing device 34 via the transporting device 32. The transfer film 56 having been unloaded is discharged by the DC dischargers 62 and 64 and AC dischargers 66 and 68.

In the above condition, the transfer drum cleaning device 58 starts cleaning the transfer film 56. First, the fur brush 74 in rotation urges the transfer film 56 against the back-up roller 80 in order to clean the transfer film 56. The toner deposited on the fur brush 74 is collected by the toner collecting roller 76, while the blade 78 scrapes the toner off the roller 76. The cleaned transfer film 56 is discharged at the same time to prepare for another image forming cycle.

The present invention pertains to a cleaning method which uses the transfer drum cleaning device 58 and will be described in detail hereinafter.

Figure 5:
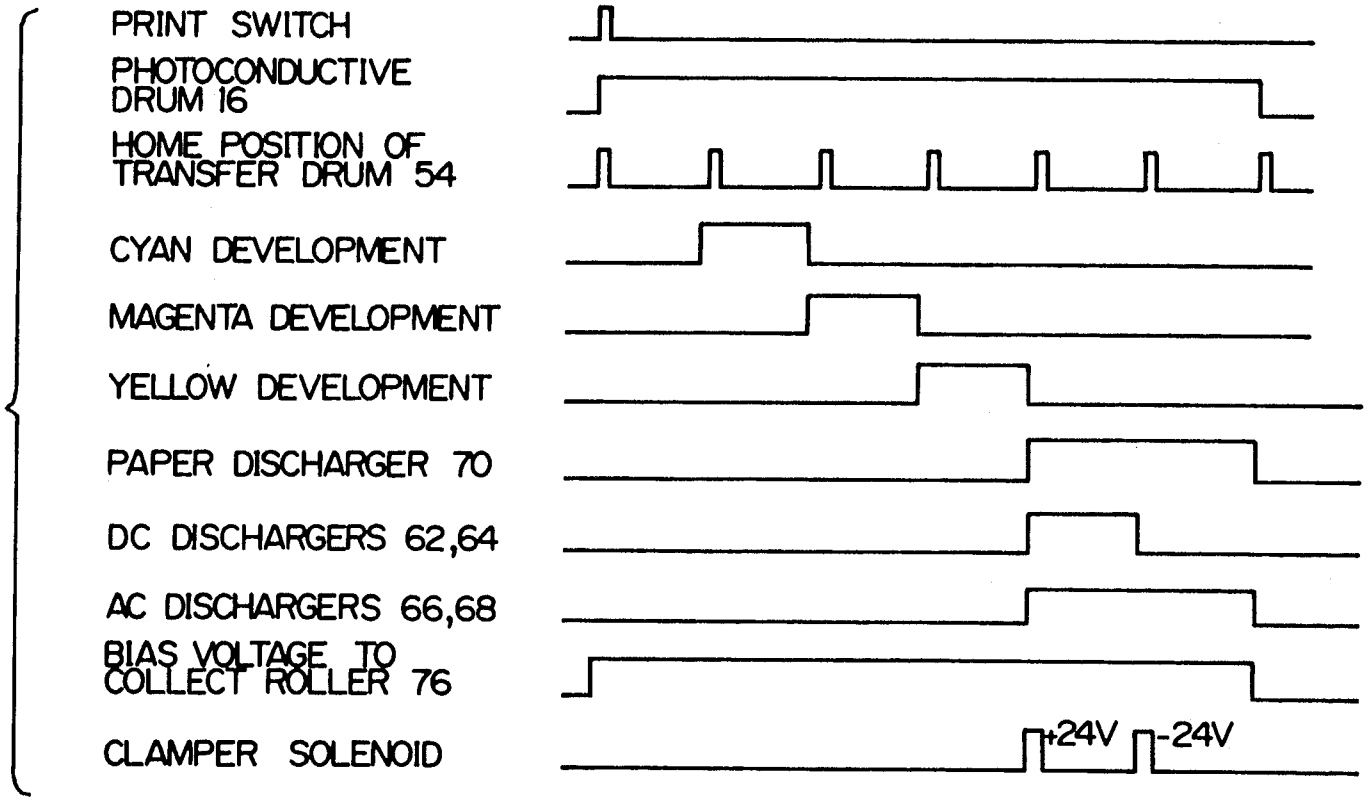
FIGS. 5, 6, 7, 8 and 9 are timing charts representative of, respectively, a first, a second, a third, a fourth and a fifth embodiment of the present invention.

Referring to FIG. 5, a timing chart representative of a first embodiment of the cleaning method in accordance with the present invention is shown. As shown, while the transfer drum cleaning device 58 is inoperative, i.e., it is spaced apart from the transfer drum 56 with the photoconductive drum 16 being operative, the fur brush 74 and tone collecting roller 76 are driven such that a bias voltage is applied to the roller 76 to collect the toner from the fur brush 74. This is successful in fully purifying the fur brush 74 before the cleaning device 58 starts on a cleaning operation. Then, the cleaning device 58 is moved toward the transfer drum 56 to cause the fur brush 74 into contact with the transfer film 56. This is followed by rotating the fur brush 74 to clean the transfer film 56.

Figure 6:
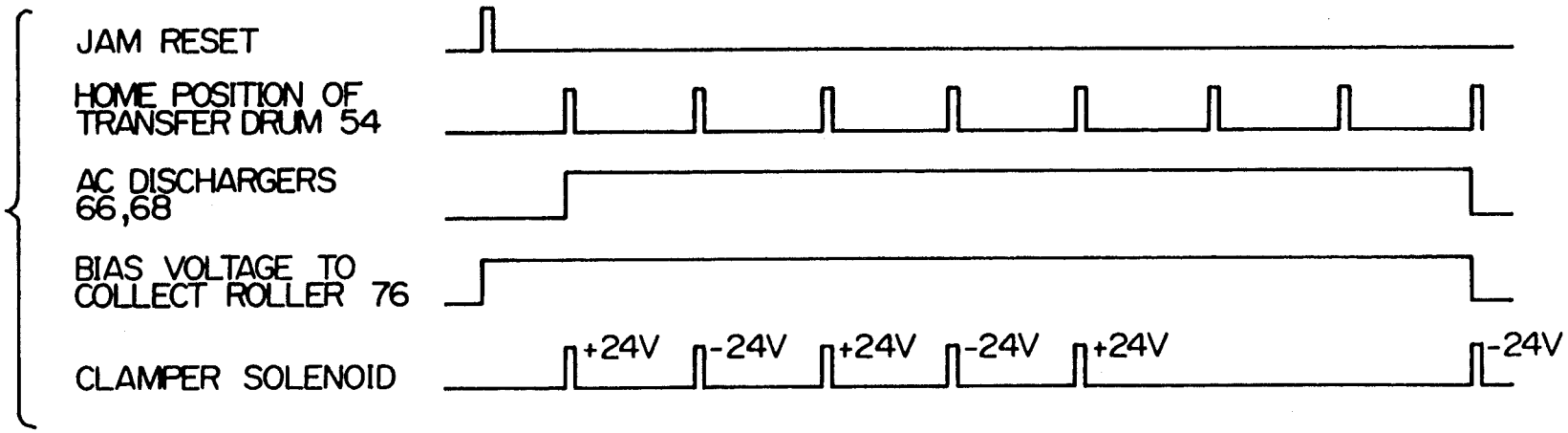

FIG. 6 shows a second embodiment of the present invention in a timing chart. As shown, this embodiment pertains to processing which occurs in the event of jam resetting. First, the fur brush 74 of the cleaning device 58 is held in contact with the transfer drum 54 to clean the transfer film 56 except for the clamper section, i.e., only from a point A to a point B as shown in FIG. 3. More specifically, the fur brush 74 is released from the transfer drum 54 in the clamper section so as not to rub itself against the clamper section. The toner deposited on the fur brush 74 as a result of such partial cleaning is collected by the toner collecting roller 76. Then, the periphery of the transfer film 56 between the points A and B is cleaned again in the same manner. After such partial cleaning operation has been repeated, the entire periphery of the transfer drum 54 including the clamper section is cleaned three consecutive times with the fur brush 74 being held in contact with the transfer drum 54. At this time, no toner accumulates in the clamper section because both the transfer drum 54 and the fur brush 74 have already been cleaned.

Figure 7:
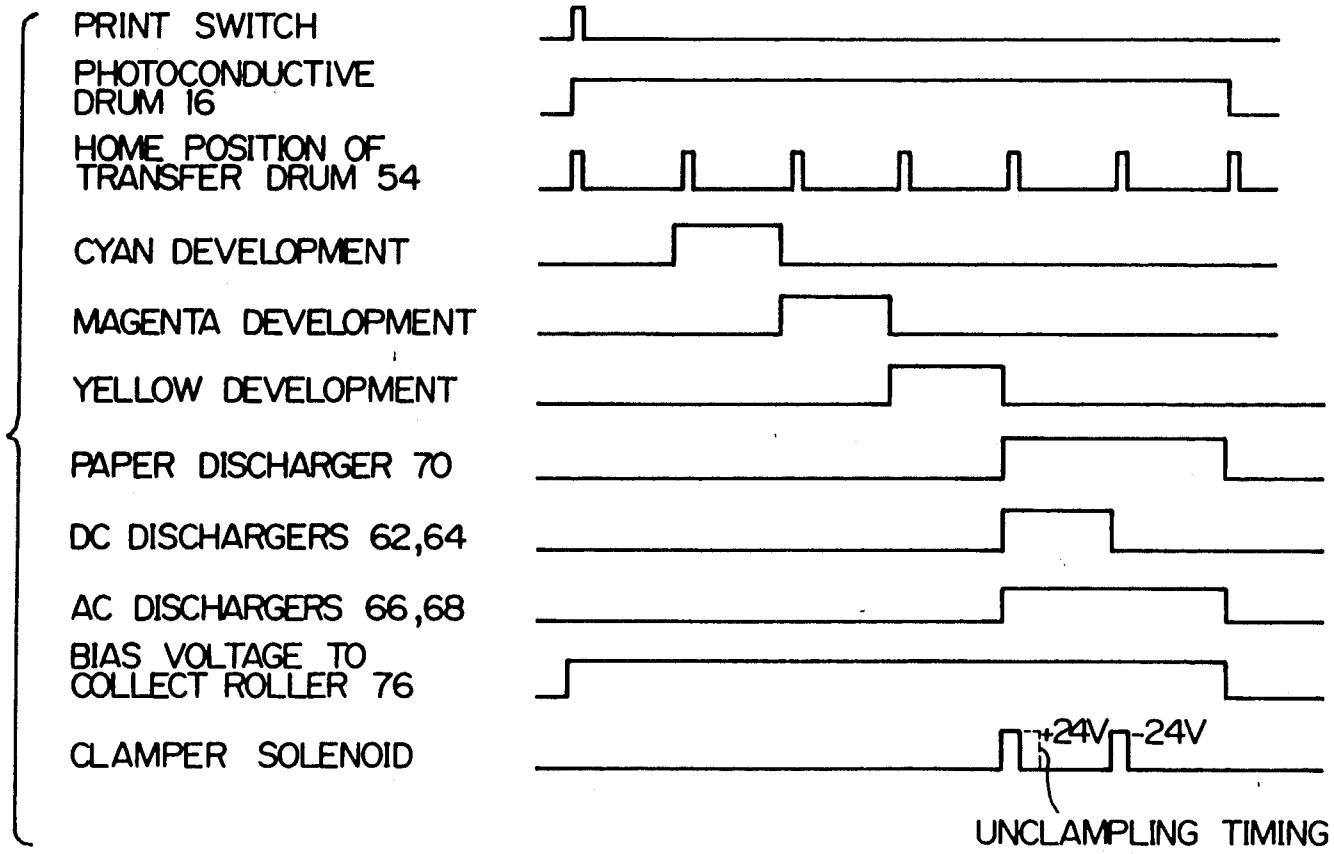

FIG. 7 is a timing chart demonstrating a third embodiment of the present invention. As shown, the fur brush 74 starts cleaning the transfer drum 54 at the clamper section of the latter and ends it at the point B just before the clamper section as shown in FIG. 3. Then, the fur brush 74 is purified. This kind of procedure is repeated thereafter.

Figure 8:
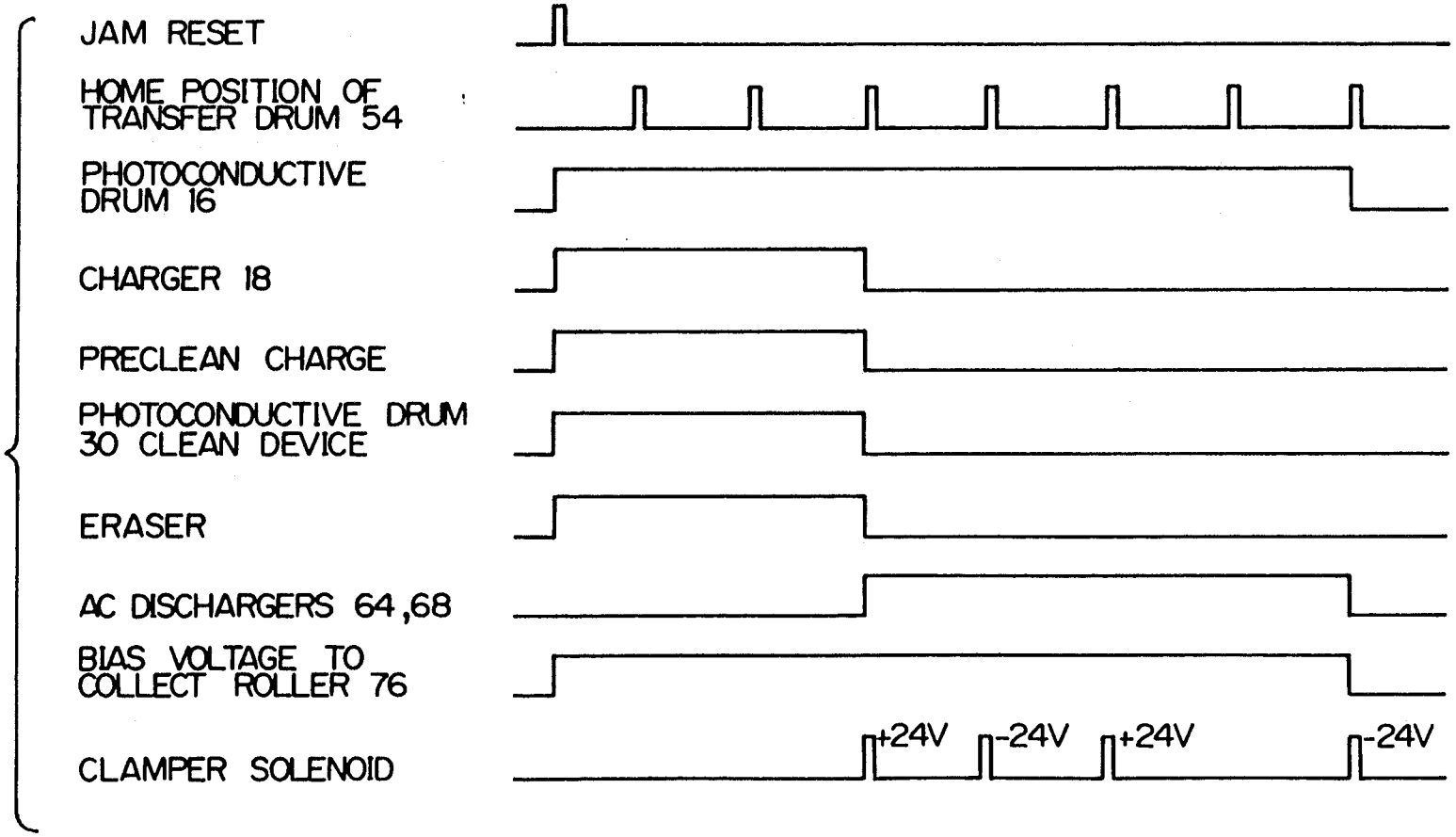

FIG. 8 is a timing chart representative of a fourth embodiment of the present invention which also pertains to processing which occurs in the event of jam resetting. As shown, after jam resetting, the photoconductive drum cleaning device 30 starts cleaning the photoconductive drum 16. The drum 16 is charged by the charger 18 for dissipating the charge thereof. Since the ratio in diameter of the transfer drum 54 to the photoconductive drum 16 is fully 1.5:1, rotating the drum 16 three times causes the drum 54 to rotate twice. As the photoconductive drum 16 is fully cleaned, the various process implements arranged around the drum 16 are turned off. Then, the transfer drum cleaning device 58 begins cleaning the transfer drum 54. The cleaning device 58 has been turned on simultaneously with jam resetting, i.e., its fur brush has been cleaned of the toner. As soon as the transfer drum 54 being cleaned by the cleaning device 58 completes one rotation, the cleaning device 58 is released from the drum 54. In this condition, the toner collecting roller 54 removes the toner from the fur brush 74 to thereby purify the fur brush 74. The cleaning device 58 is now ready to perform another cleaning operation.

Figure 9:
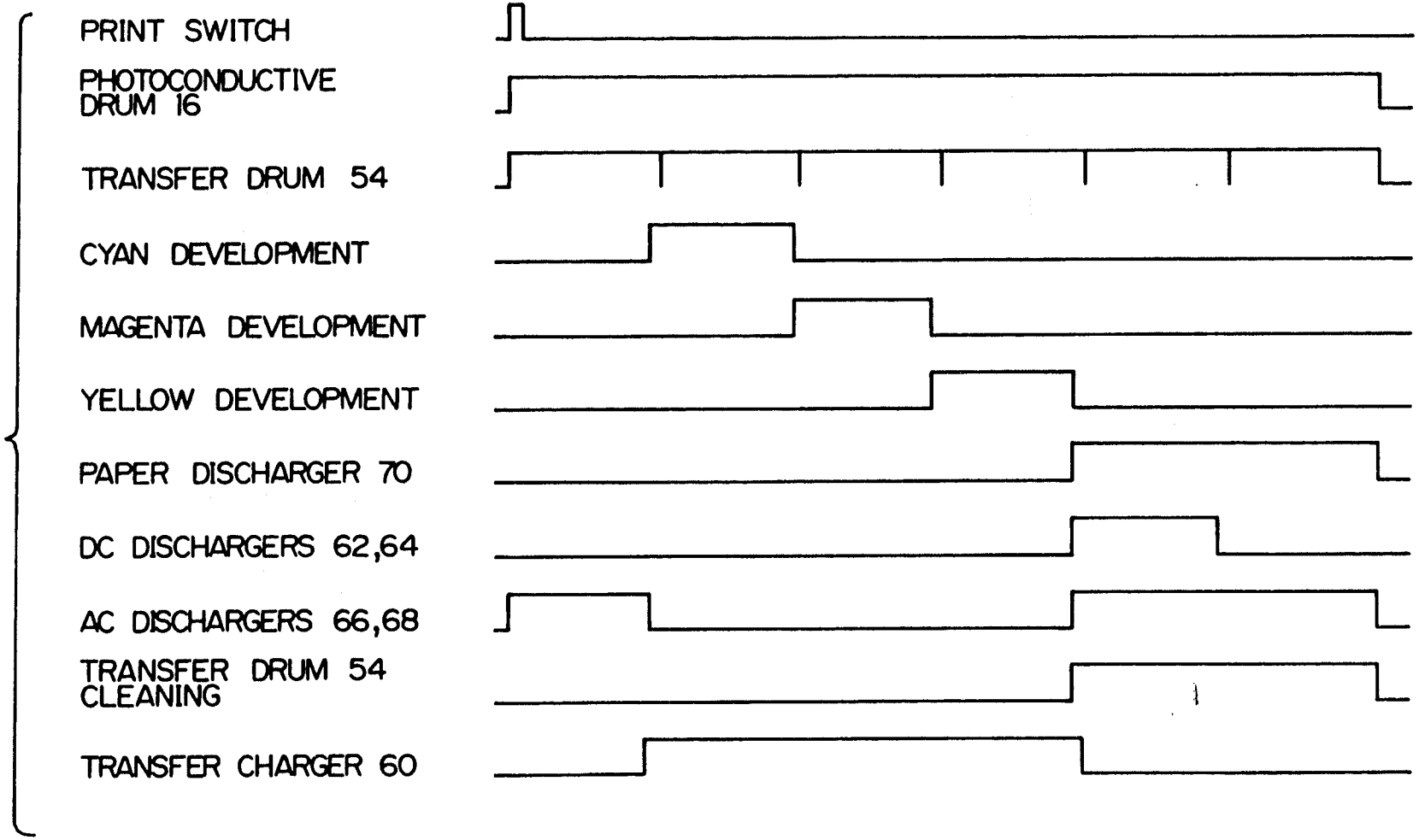

FIG. 9 shows a fifth embodiment of the present invention in a timing chart. In this particular embodiment, after the development of latent images in respective colors and the transfer of the resulting toner images, the paper discharger 70 discharges the paper sheet 100. The DC dischargers 62 and 64 and AC dischargers 66 and 68 are also activated. It should be noted that the DC discharge ends when the transfer drum 54 completes one rotation. The transfer drum 54 is cleaned by such a procedure.

In summary, it will be seen that a method of cleaning a transfer drum of the present invention achieves various unprecedented advantages, as enumerated below.

(1) The first embodiment cleans the fur brush 74 when the transfer drum 54 is not cleaned. The fur brush 74, therefore, start cleaning the transfer drum 54 in a purified state at all times. This prevents the toner from accumulating in the clamper section of the transfer drum 54 and thereby smearing the leading edge of the paper sheet 100.

(2) The second and third embodiments clean the transfer drum 54 a plurality of consecutive times when the drum 54 is noticeably smeared such as when a paper jam has occurred. This purifies the entire periphery of the transfer drum 54 and, therefore, frees the paper sheet 100 from smears. In addition, one is prevented from touching the clamper section of the transfer drum 54 during the removal of a jamming sheet.

(3) The fourth embodiment cleans the transfer drum 54 after the photoconductive drum 16 has been fully purified. Hence, smears on the photoconductive drum 16 are prevented from being transferred to the transfer film 56, whereby the paper sheet 100 is safeguard against smears otherwise caused on its back.

(4) The fifth embodiment sufficiently discharges the transfer drum 54 while cleaning it and, therefore, eliminates the need for an extra discharging step. This is successful in enhancing high-speed copying operations and precluding incomplete image transfer.

Various modifications will become possible for those skilled in the art after receiving the teachings of the present disclosure without departing from the scope thereof.

What is claimed is:

1. A method of cleaning a transfer drum device in an electrophotographic apparatus comprising a movable image carrier for forming a toner image thereon, and a transfer drum device located to face said image carrier, said transfer drum device comprising a transfer film wound around said transfer drum device, a clamping section for clamping a paper sheet to which said toner image is to be transferred and a fur brush rotatable in contact with said transfer film of said transfer drum device for removing a toner left untransferred on said transfer film, said method comprising the steps of:

(a) executing a first cleaning mode in which said fur brush smeared by cleaning said transfer film is released from said transfer film before said clamping section reaches said fur brush in order to prevent said fur brush rubbing against said clamping section; and (b) executing, after said first cleaning mode, a second cleaning mode in which said fur brush is not released from said transfer film in said clamping section in order to clean the entire periphery of said transfer drum device including said clamping section and said transfer film.

2. A method as claimed in claim 1, wherein said fur brush comprises a conductive member, said method further comprising the step of (c) discharging said transfer film of said transfer drum device.

3. A method as claimed in claim 1, further comprising the steps of, prior to step (a), cleaning said image carrier at least twice to remove the untransferred toner from said image carrier.

4. A method as claimed in claim 1, wherein said transfer drum device further comprises a toner collecting roller in contact with said fur brush for collecting said toner from said fur brush, said method further comprising the step of (c) applying a bias voltage to said toner collecting roller to collect the toner from said fur brush.

5. A method of cleaning a transfer drum device in an electrophotographic apparatus comprising a movable image carrier for forming a toner image thereon and a transfer drum device located to face said image carrier, said transfer drum device comprising a transfer film wound around said transfer drum device, a clamping section for clamping a paper sheet to which said toner image is to be transferred and a fur brush rotatable in contact with said transfer film of said transfer drum for removing toner left untransferred on said transfer film, said method comprising the steps of:

(a) starting cleaning said transfer film of said transfer drum device at said clamping section; and (b) ending cleaning said transfer film at a point ahead of said clamping section such that said fur brush smeared by cleaning said transfer film is released from said transfer film before said clamping section reaches said fur brush in order to prevent said fur brush rubbing against said clamping section.

6. A method as claimed in claim 5, further comprising the step of (c) cleaning said fur brush.

7. A method as claimed in claim 6, further comprising the step of (d) cleaning said clamping section at least once with said fur brush cleaned in step (c).

8. A method as claimed in claim 5, wherein said fur brush comprises a conductive member, said step (b) comprising the step of (c) discharging said transfer film of said transfer drum device.

9. A method as claimed in claim 5, further comprising, prior to step (b), the step of (c) cleaning said image carrier at least twice to remove the untransferred toner from said image carrier.

10. A method as claimed in claim 5, wherein said transfer drum device further comprises a toner collecting roller in contact with said fur brush for collecting said toner from said fur brush, said method further comprising the step of (c) applying a bias voltage to said toner collecting roller to collect the toner from said fur brush.

* * * * *